US008336513B2

(12) United States Patent
Lee et al.

(10) Patent No.: US 8,336,513 B2
(45) Date of Patent: Dec. 25, 2012

(54) VARIABLE TAPPET

(75) Inventors: Ju Hun Lee, Gwangmyung-si (KR); Gee Wook Shin, Hwaseong (KR); Jin Kook Kong, Suwon (KR); Soo Hyung Woo, Yongin (KR); Jin Soon Kim, Yongin (KR)

(73) Assignee: Hyundai Motor Company, Seoul (KR)

( * ) Notice: Subject to any disclaimer, the term of this patent is extended or adjusted under 35 U.S.C. 154(b) by 322 days.

(21) Appl. No.: 12/793,174

(22) Filed: Jun. 3, 2010

(65) Prior Publication Data

US 2010/0307438 A1 Dec. 9, 2010

(30) Foreign Application Priority Data

Jun. 4, 2009 (KR) ..... 10-2009-0049637

(51) Int. Cl.
*F01L 1/14* (2006.01)

(52) U.S. Cl. ..... 123/90.48; 123/90.16

(58) Field of Classification Search ..... 123/90.49, 123/90.5, 90.52, 90.53, 90.54, 90.56–90.59, 123/90.55, 90.48, 90.16
See application file for complete search history.

(56) References Cited

U.S. PATENT DOCUMENTS

| | | | | |
|---|---|---|---|---|
| 6,397,804 | B1 * | 6/2002 | Harada et al. | 123/90.16 |
| 7,681,543 | B2 * | 3/2010 | Shin et al. | 123/90.48 |
| 7,987,826 | B2 * | 8/2011 | Kwak et al. | 123/90.16 |
| 8,001,940 | B2 * | 8/2011 | Sailer et al. | 123/90.48 |

FOREIGN PATENT DOCUMENTS

| | | | |
|---|---|---|---|
| JP | 2002-106313 | A | 4/2002 |
| KR | 10-2009-0035179 | A | 4/2009 |
| WO | WO 2008092884 | A1 * | 8/2008 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable tappet may include an outer tappet body, an inner tappet body that is slidably disposed within the outer tappet body and selectively connected with the outer tappet body, a lost motion elastic member that is disposed within the outer tappet body and elastically supports the outer tappet body, and a connecting unit that is slidably disposed within the inner tappet body and selectively connects the outer tappet body and the inner tappet body.

4 Claims, 8 Drawing Sheets

VARIABLE TAPPET

CROSS-REFERENCE TO RELATED APPLICATION

The present application claims priority to Korean Patent Application No. 10-2009-0049637 filed on Jun. 4, 2009, the entire contents of which is incorporated herein for all purposes by this reference.

BACKGROUND OF THE INVENTION

1. Field of the Invention

The present invention relates to a variable tappet. More particularly, the present invention relates to a variable tappet that can vary valve lift according to an engine operation condition.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches has been undertaken. For example, research has been undertaken for a variable valve lift (VVL) apparatus that enables different lifts depending on an engine speed, and for a variable valve timing (VVT) apparatus that opens/closes the valves with different timing depending on the engine speed.

A variable valve lift (VVL) apparatus can be divided into two variable valve lift apparatuses. One type of the apparatus is to control operations of a swing arm and the other type of the apparatus is to vary tappet for varying valve lift.

In the variable tappet type, more than two locking pins, which have to be used to each inner and outer tappet body, are needed and hydraulic lines and guides for controlling the locking pins are also needed.

Also, a stopper and so on, which prevents the locking pin or a connecting pin from separating by a return spring, is needed. And if a tappet is formed as a cylinder shape, an auxiliary element for preventing rotation of the tappet is required.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable tappet that can vary valve lift with one connecting pin.

The variable tappet may include an outer tappet body, an inner tappet body that is slidably disposed within the outer tappet body and selectively connected with the outer tappet body, a lost motion elastic member that is disposed within the outer tappet body and elastically supports the outer tappet body, and a connecting unit that is slidably disposed within the inner tappet body and selectively connects the outer tappet body and the inner tappet body.

The connecting unit may include a connecting pin slidably coupled in the inner tappet body and supplied with hydraulic pressure to selectively connect the outer tappet body and the inner tappet body, and an elastic member disposed in the inner tappet body and supplying an elastic force to the connecting pin.

The connecting pin may include a connecting pin body slidable in the inner tappet body, and a protrusion that is protruded from the connecting pin body and selectively connected with the outer tappet body.

A plurality of protrusions may be formed to the connecting pin.

The connecting pin body and the protrusion may be monolithically formed.

The inner tappet body may include a connecting pin sliding groove through which the protrusion of the connecting pin is slidably mounted.

The outer tappet body may include a stepped portion and the protrusion of the connecting pin is selectively caught therein.

The inner tappet body may include a guide groove that is formed corresponding to the stepped portion and wherein the guide groove and the stepped portion are slidably engaged each other.

The inner tappet body may include an oil hole that is formed to a side of the inner tappet body for selectively supplying the hydraulic pressure to the connecting pin.

The present invention has been made in an effort to provide a variable tappet that can vary valve lift with one connecting pin.

The variable tappet in another aspect of the present invention can vary valve lift with one connecting pin with simple hydraulic lines for controlling the tappet and simple scheme so that elements numbers and manufacturing cost can be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
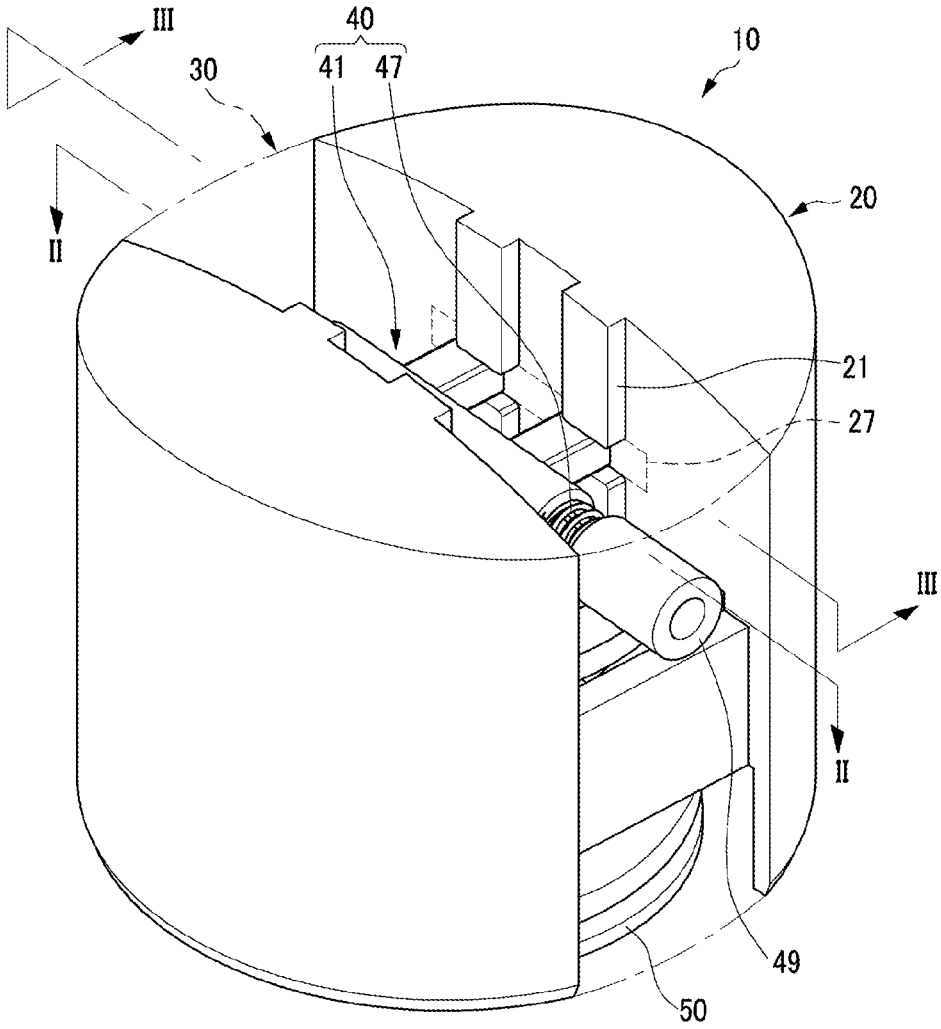
FIG. 1 is a perspective view showing an exemplary variable tappet according to the present invention in high lift mode.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
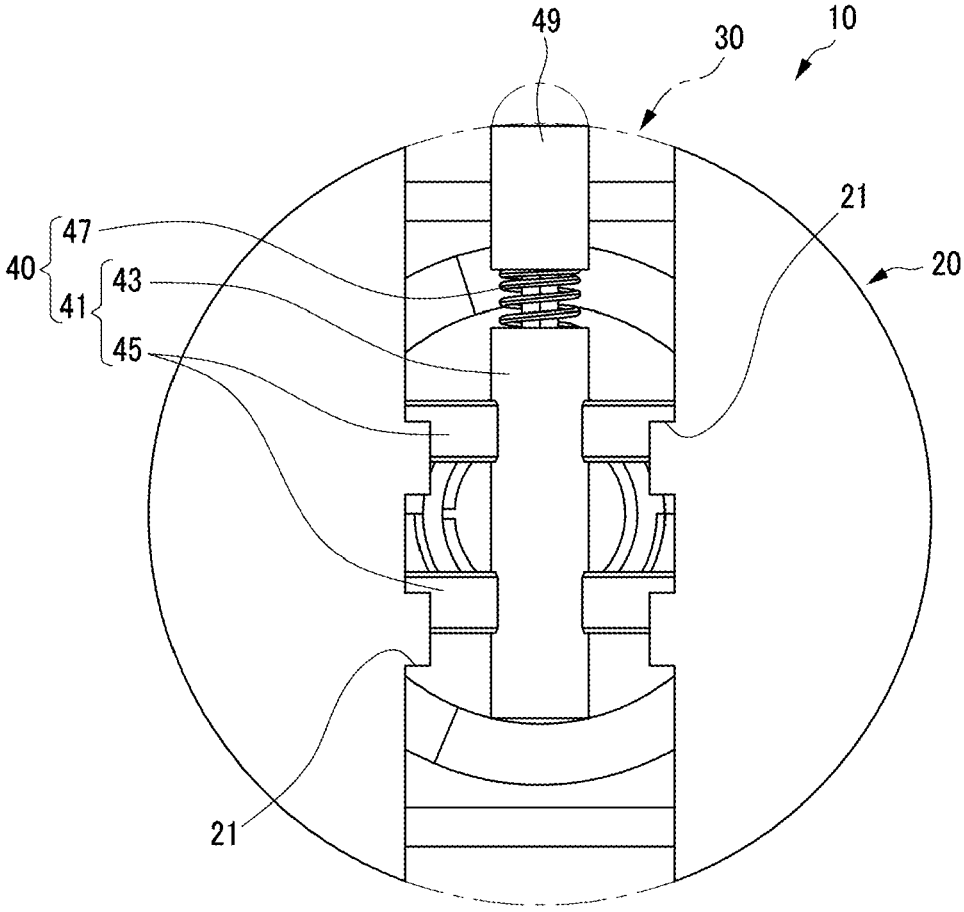
FIG. 2 is a cross-sectional view along the line II-II of FIG. 1.
Figure 3:
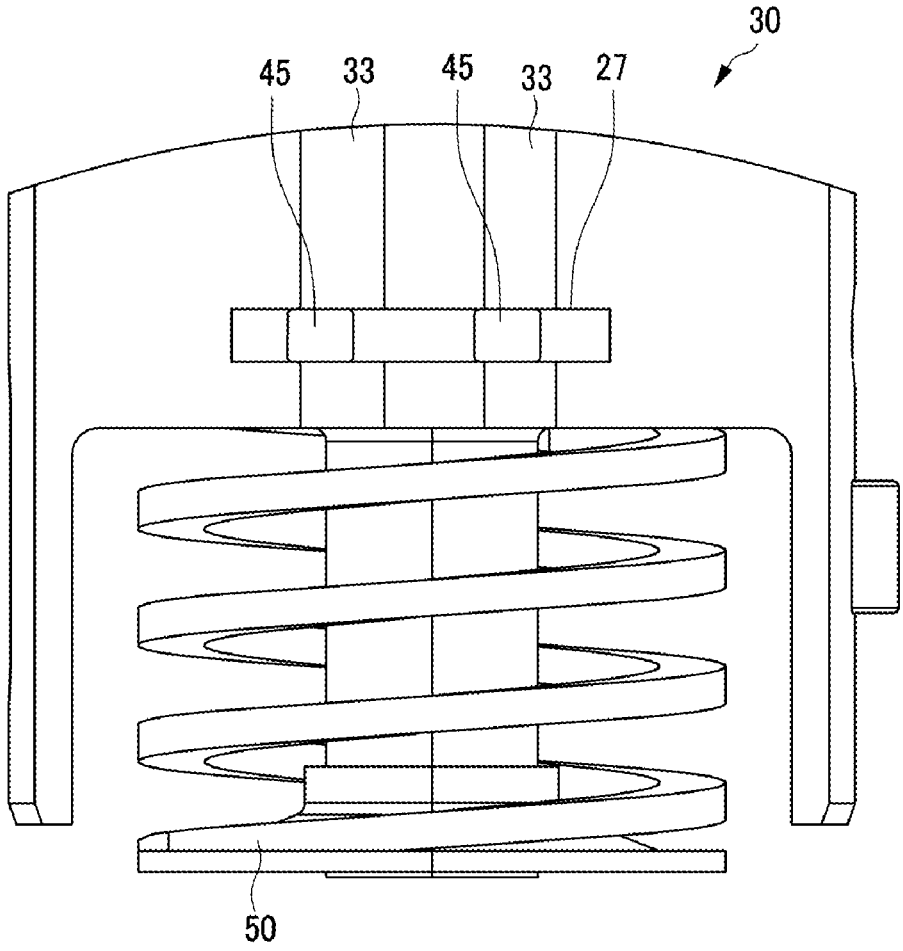
FIG. 3 is a cross-sectional view along the line of FIG. 1.

FIG. 1 is a perspective view showing a variable tappet according to an exemplary embodiment of the present invention in high lift mode and FIG. 2 is a cross-sectional view along the line II-II of FIG. 1. FIG. 3 is a cross-sectional view along the line of FIG. 1 and FIG. 7 is a perspective view of an inner tappet body of a variable tappet according to an exemplary embodiment of the present invention.

Figure 4:
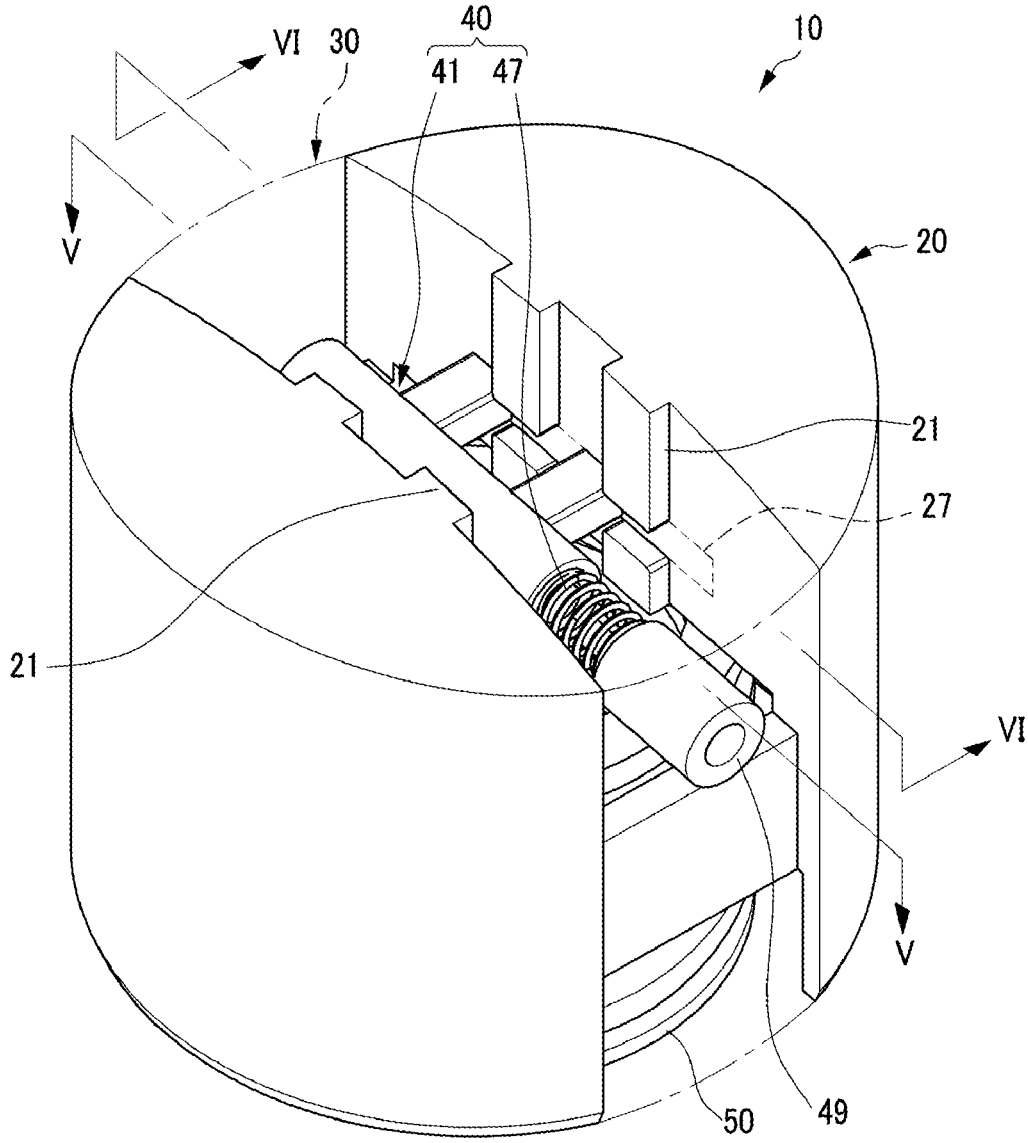
FIG. 4 is a perspective view showing an exemplary variable tappet according to the present invention in low lift mode.
Figure 5:
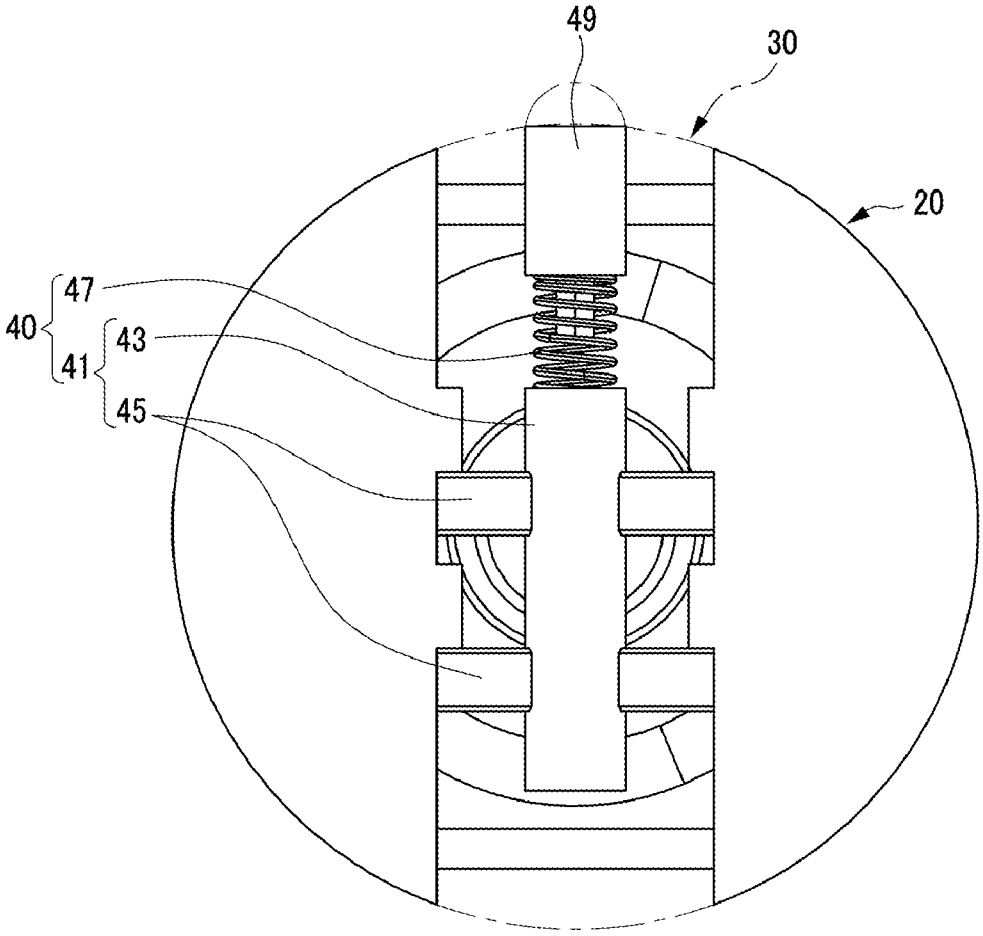
FIG. 5 is a cross-sectional view along the line V-V of FIG. 4.
Figure 6:
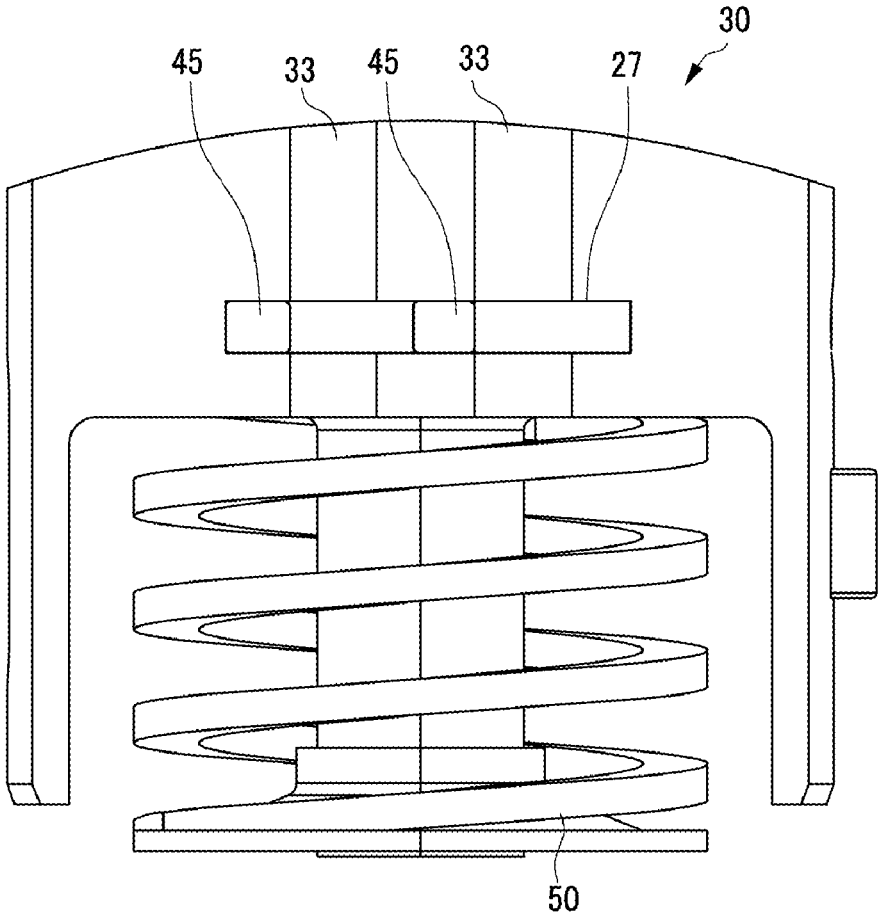
FIG. 6 is a cross-sectional view along the line VI-VI of FIG. 4.

FIG. 4 is a perspective view showing a variable tappet according to an exemplary embodiment of the present invention in low lift mode and FIG. 5 and FIG. 6 are cross-sectional views along the line V-V and VI-VI of FIG. 4 respectively.

Figure 7:
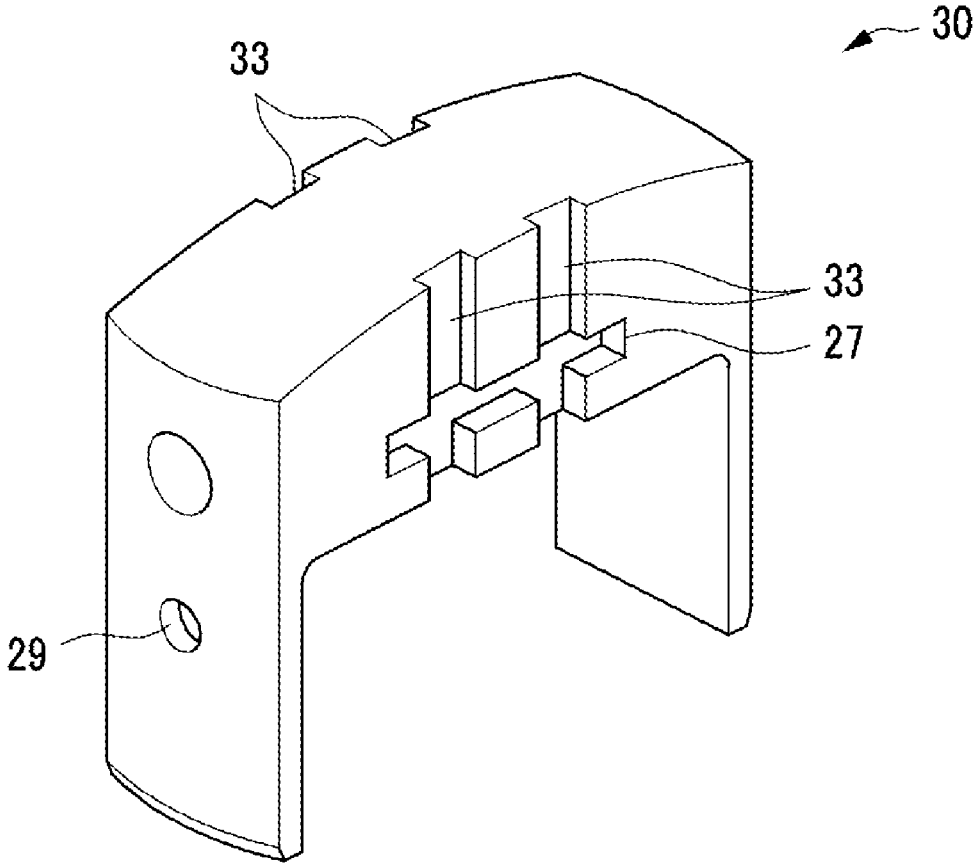
FIG. 7 is a perspective view of an inner tappet body of an exemplary variable tappet according to the present invention.

FIG. 1 to referring to FIG. 7, a variable tappet 10 according to an exemplary embodiment of the present invention includes an outer tappet body 20, an inner tappet body 30 that is disposed within the outer tappet body 20 and selectively connected with the outer tappet body 20, a lost motion spring 50 that is disposed within the outer tappet body 20 and elastically supports the outer tappet body 20 and a connecting unit 40 that is slidably disposed within the inner tappet body 30 and selectively connects the outer tappet body 20 and the inner tappet body 30.

The connecting unit 40 includes a connecting pin 41 that is supplied hydraulic pressure and selectively connects the outer tappet body 20 and the inner tappet body 30 and a return spring 47 supplies elastic force to the connecting pin 41.

A supporting portion 49 is disposed to the inner tappet body 30 to support the return spring 47.

An oil hole 29, referring to FIG. 7, is formed to a side of the inner tappet body 30 to supply hydraulic pressure to the connecting pin 41.

The connecting pin 41 includes a connecting pin body 43 and a protrusion 45 that is protruded from the connecting pin body 43 and selectively connected with the outer tappet body 20.

The connecting pin body 43 and the protrusion 45 may be integrally formed.

The inner tappet body 30 may include a connecting pin sliding groove 27 that the connecting pin 41 is slidably mounted thereto and the protrusion 45 of the connecting unit 50 is selectively caught in a stepped portion 21 of the outer tappet body 20.

The inner tappet body 30 includes a guide groove 33 that is formed corresponding to the stepped portion 21.

That is, the guide groove 33 of the inner tappet body 30 and the stepped portion 21 of the outer tappet body 20 are formed such that the inner tappet body 30 and the outer tappet body 20 are slidably engaged to guide each other in low lift mode.

Figure 8:
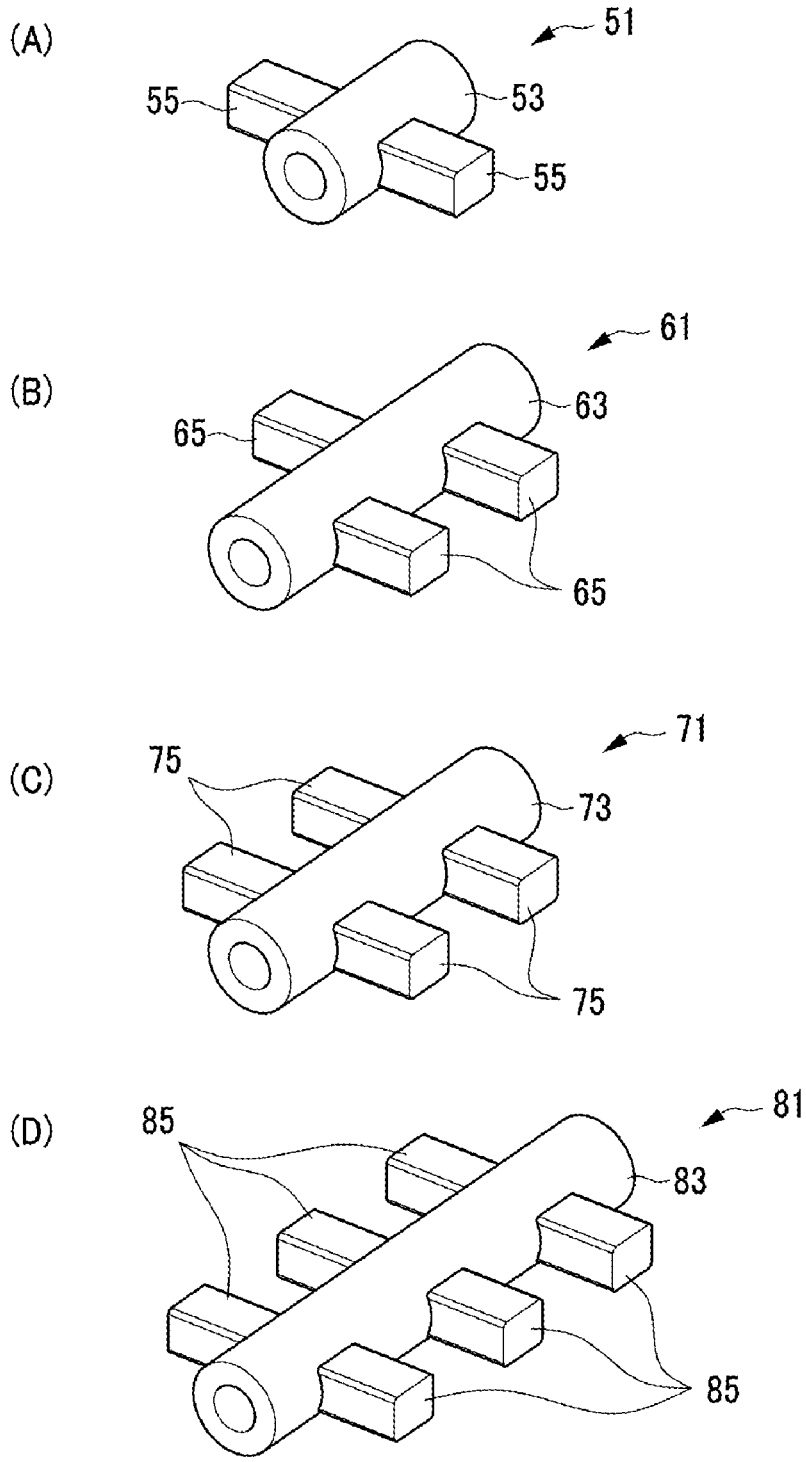
FIG. 8 is a perspective view of connecting pins according to exemplary variations.

FIG. 8 is a perspective view of connecting pins according to exemplary variations.

As shown in FIG. 8, connecting pins 51, 61, 71 and 81 are plurally formed from a connecting pin body 53, 63, 73 and 83 and protrusions 55, 65, 75 and 85 and thus design of the variable tappet can be freely selected and the variable tappet can be provided to different size tappet without excessive design change.

Hereinafter, referring the drawings, operations of the variable tappet according to the exemplary embodiment of the present invention will be described.

FIGS. 1 to 3 and referring to FIG. 7, according to operation of an engine (not shown), an ECU (engine control unit: not shown) controls the variable tappet 10 to operate in high lift mode.

An operation of an engine, an operation and control of an ECU are obvious to a skilled person in the art, so a detailed explanation will be omitted.

In the lift mode, hydraulic pressure is supplied to the connecting pin 41, and the connecting pin, as shown in FIG. 3, moves in the connecting pin sliding groove 27 of the inner tappet body 30. And thus the protrusion 45 is disposed within the stepped portion 21 of the outer tappet body 30 so that relative movement of the inner tappet body 30 toward the outer tappet body 20 is restricted.

That is, the inner tappet body 30 and the outer tappet body 20 reciprocate integrally.

Thus, when a high lift cam (not shown) rotates to push the outer tappet body 20, the variable tappet 10 opens a valve (not shown).

Hereinafter, referring FIG. 4 to FIG. 7, operations of the variable tappet according to an exemplary embodiment of the present invention in low lift mode will be described.

When an engine is operated in low load such as idle or cruse state, the ECU controls the variable tappet 10 to operate in the low lift mode, such that hydraulic pressure supplied to the connecting pin 41 is released and the return spring 47 supplies elastic force to the connecting pin 41.

The connecting pin 41 in the connecting pin sliding groove 27 of the inner tappet body 30 moves and the protrusion 45 is not positioned within the stepped portion 21.

When the high lift cam (not shown) pushes the outer tappet body 20, the inner tappet body 30 and the outer tappet body 20 are separated and independently operated. That is, the outer tappet body 20 reciprocates in lost motion.

The lost motion spring 50 elastically supports the outer tappet body 20.

In this case, the stepped portion 21 reciprocates along the guide groove 33.

If a high lift cam and a low lift cam are provided with, the high lift cam contacts the outer tappet body 20 and the low lift cam contacts the inner tappet body 30.

Thus, in the low lift mode, a valve (not shown) is opened by rotation of the low lift cam, so that valve lift and opened timing is relatively reduced.

If the low lift cam is omitted, the high lift cam (or general cam) contacts the outer tappet body 20, while the valve is not opened in the low lift mode.

In this case, the low lift mode is replaced by CDA (cylinder deactivation) mode.

As described above, according to scheme of cams, the variable tappet according to the exemplary embodiment of the present invention can realize the high and low lift mode or the high (general) and CDA mode.

For convenience in explanation and accurate definition in the appended claims, the terms "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable tappet comprising:

an outer tappet body;

an inner tappet body that is slidably disposed within the outer tappet body and selectively connected with the outer tappet body;

a lost motion elastic member that is disposed within the outer tappet body and elastically supports the outer tappet body; and a connecting unit that is slidably disposed within the inner tappet body and selectively connects the outer tappet body and the inner tappet body;

wherein the connecting unit comprises:

a connecting pin slidably coupled in the inner tappet body and supplied with hydraulic pressure to selectively connect the outer tappet body and the inner tappet body; and an elastic member disposed in the inner tappet body and supplying an elastic force to the connecting pin;

wherein the connecting pin comprises:

a connecting pin body slidable in the inner tappet body; and a protrusion that is protruded from the connecting pin body and selectively connected with the outer tappet body;

wherein the inner tappet body comprises a connecting pin sliding groove through which the protrusion of the connecting pin is slidably mounted;

wherein the outer tappet body comprises a stepped portion and the protrusion of the connecting pin is selectively caught therein; and wherein the inner tappet body comprises a guide groove that is formed corresponding to the stepped portion and wherein the guide groove and the stepped portion are slidably engaged each other.

2. The variable tappet of claim 1, wherein a plurality of protrusions are formed to the connecting pin.

3. The variable tappet of claim 1, wherein the connecting pin body and the protrusion are monolithically formed.

4. The variable tappet of claim 1, wherein the inner tappet body comprises an oil hole that is formed to a side of the inner tappet body for selectively supplying the hydraulic pressure to the connecting pin.

* * * * *